US010532561B2

(12) United States Patent
Ingram et al.

(10) Patent No.: US 10,532,561 B2
(45) Date of Patent: Jan. 14, 2020

(54) METROLOGY-BASED PATH PLANNING FOR INKJET PRINTING ALONG A CONTOURED SURFACE

(71) Applicant: The Boeing Company, Chicago, IL (US)

(72) Inventors: Luke C. Ingram, Summerville, SC (US); Anthony W. Baker, Gilbertsville, PA (US); Zachary R. Smith, Hanahan, SC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/146,592

(22) Filed: Sep. 28, 2018

(65) Prior Publication Data

US 2019/0030886 A1 Jan. 31, 2019

Related U.S. Application Data

(63) Continuation-in-part of application No. 15/646,705, filed on Jul. 11, 2017, now Pat. No. 10,293,601.

(51) Int. Cl.

| | |
|---|---|
| ***B41J 2/045*** | (2006.01) |
| ***B41J 3/407*** | (2006.01) |
| ***B41M 5/00*** | (2006.01) |

(52) U.S. Cl.

CPC ..... *B41J 2/04508* (2013.01); *B41J 2/04586* (2013.01); *B41J 3/4073* (2013.01); *B41M 5/0017* (2013.01)

(58) Field of Classification Search

CPC ..... B41J 3/4073; B41J 11/008; B41J 25/308; B41J 2/04508; B05B 13/0452; B05B 13/0431; B05B 13/0457; B05B 12/02

See application file for complete search history.

(56) References Cited

U.S. PATENT DOCUMENTS

| | | | | |
|---|---|---|---|---|
| 5,255,352 | A * | 10/1993 | Falk | G05B 19/4099 345/427 |
| 10,232,636 | B2 * | 3/2019 | Martins Pinto | B05B 3/00 |
| 2003/0126581 | A1 * | 7/2003 | Pang | G03F 1/26 716/52 |
| 2013/0257984 | A1 * | 10/2013 | Beier | B41J 2/135 347/37 |

(Continued)

*Primary Examiner* — John Zimmermann

(74) *Attorney, Agent, or Firm* — Miller, Matthias & Hull LLP

(57) ABSTRACT

A method of collecting a metrology data set of a contoured surface with a metrology system and executing an automatic control plan for printing on a contoured surface is disclosed. The method includes attaching a work piece to a work piece frame and scanning a contoured surface of the work piece to obtain a metrology data set, a three-dimensional point cloud model is generated based on the metrology data set. Additionally, the method includes defining a spatial reference model of the work piece frame, and defining a print path for a print head assembly of a surface treatment assembly. Furthermore, the method includes discretizing the contoured surface into a plurality of regions and the print path is further defined into at least one independent regional print path for each region of the plurality of regions. Moreover, a computer software simulation verifies a control plan for printing on the contoured surface.

20 Claims, 9 Drawing Sheets

(56) References Cited

U.S. PATENT DOCUMENTS

| | | | | |
|---|---|---|---|---|
| 2014/0063096 | A1* | 3/2014 | Pitz | B05O 5/0212 347/9 |
| 2015/0042716 | A1* | 2/2015 | Beier | B41J 3/4073 347/14 |
| 2017/0146462 | A1 | 5/2017 | Baker et al. | |

* cited by examiner

METROLOGY-BASED PATH PLANNING FOR INKJET PRINTING ALONG A CONTOURED SURFACE

CROSS-REFERENCE TO RELATED APPLICATION

This application is a continuation-in-part application that is based on and claims priority to U.S. patent Non-Provisional application Ser. No. 15/646,705, filed on Jul. 11, 2017, with the United States Patent and Trademark Office, the disclosure of which is hereby incorporated by reference in its entirety.

FIELD

The present disclosure relates generally to surface treatment systems and methods, and more specifically to automated controls for ink jet printing along a complex contoured surface.

BACKGROUND

Treating and coating structural surfaces of machines, such as commercial aircraft, is a long and extensive process. Surface treatment often requires coating a structural surface that includes a variety of large contoured surfaces. Furthermore, coating the structural surfaces includes applying multiple layers of coatings for engineering properties, as well as to apply a decorative livery. The decorative livery is applied using a complex process which requires a series of masking operations followed by applying colored paints or coatings where they are needed. These masking and painting operations are serially repeated until the exterior surface treatment is completed. Performing these processes on large areas with a variety of contoured surfaces, therefore, requires a significant amount of time and resources.

SUMMARY

In accordance with one aspect of the present disclosure a method of collecting a metrology data set along a contoured surface with a metrology system and executing an automated metrology-based control plan for printing on the contoured surface is disclosed. The method may include attaching a work piece, having the contoured surface to be printed on, to a work piece frame including at least one frame target and scanning the contoured surface of the work piece, with the metrology system, to obtain the metrology data set of the work piece having the contoured surface and the work piece frame. The method may further include generating a three-dimensional point cloud model, with a computing device, of the work piece frame and the work piece having the contoured surface, the three-dimensional point cloud model based on the metrology data set. Additionally, the method may include defining a spatial reference model of the work piece frame based on a detection of the at least one frame target by the metrology system. Furthermore, the method includes defining a print path for a print head assembly of a surface treatment assembly to follow as the surface treatment assembly prints along the contoured surface, the print path based off the three-dimensional point cloud model. Moreover, the method includes discretizing the contoured surface of the work piece into a plurality of regions, wherein the print path is further defined into at least one independent regional print path for each region of the plurality of regions. The method further includes accessing a computer software, with the computing device, including a simulation module, wherein the computer software receives the plurality of regions of the contoured surface and the at least one independent regional print path for each region of the plurality of regions, and wherein the simulation module executes a simulation to verify a control plan programmed to control the surface treatment assembly during printing along the contoured surface.

In accordance with another aspect of the present disclosure, a metrology system for collecting a metrology data set along a contoured surface, the metrology data set used in the development a control plan for a surface treatment assembly configured to print along the contoured surface is disclosed. The metrology system may include at least one sensor configured to scan a work piece frame including at least one frame target, the work piece frame removably attached to a work piece having the contoured surface, and the metrology system generates the metrology data set including the work piece frame, the at least one frame target, and the work piece having the contoured surface. Additionally, the system may include a computing device communicably coupled to the metrology system and programmed to receive the metrology data set, the computing device programmed to analyze the metrology data set and generate a three-dimensional point cloud model of the work piece frame and the work piece having the contoured surface. The computing device is further programmed to define a spatial reference model of the work piece frame based on the three-dimensional point cloud model and detection of the at least one frame target coupled to the work piece frame by the metrology system. Additionally, the computing device may be programmed to define a print path for a print head assembly of the surface treatment assembly to follow as the surface treatment assembly prints along the contoured surface, the print path based off the three-dimensional point cloud model. Furthermore, the computing device may discretize the contoured surface into a plurality of regions, wherein the print path is further defined into at least one independent regional print path for each region of the plurality of regions. Moreover, the computing device may include or otherwise access a computer software including a simulation module, wherein the computer software receives the plurality of regions of the contoured surface and the at least one independent regional print path for each region of the plurality of regions, and wherein the simulation module executes a simulation to verify a control plan programmed to control the surface treatment assembly during printing along the contoured surface.

In accordance with yet another aspect of the present disclosure, an automated surface assembly communicably coupled to a metrology system for collecting a metrology data set along a contoured data set, the automated surface assembly configured to utilize the metrology data set during printing of a surface treatment along the contoured surface is disclosed. The automated surface treatment assembly may include a print head assembly configured for printing a surface treatment along the contoured surface. Furthermore, an automated robot assembly may be operably coupled to the print head assembly and configured to position and move the print head assembly along the contoured surface. Additionally, at least one sensor may be operably coupled to the metrology system and configured to scan a work piece frame including at least one frame target, a work piece having the contoured surface, the work piece removably attached to the work piece frame, wherein the metrology system generates a metrology data set including the work piece frame, the at least one frame target, and the work piece having the contoured surface. Additionally, a control system may be communicably coupled to the automated surface assembly and the metrology system, the control system configured to control and execute a plurality of operational control signals for each of the automated surface assembly and the metrology system. The automated surface treatment assembly may further include a computing device communicably coupled to the control system, the automated surface assembly, and the metrology system. The computing device programmed to receive the metrology data set, the computing device programmed to analyze the metrology data set and generate a three-dimensional point cloud model of the work piece frame and the work piece having the contoured surface. The computing device may further define a spatial reference model of the work piece frame based on the three-dimensional point cloud model and detection of the at least one frame target coupled to the work piece frame by the metrology system. Additionally, the computing device defines a print path for a print head assembly of the surface treatment assembly to follow as the surface treatment assembly prints along the contoured surface, the print path based off the three-dimensional point cloud model. The computing system may be further programmed to discretize the contoured surface into a plurality of regions, wherein the print path is further defined into at least one independent regional print path for each region of the plurality of regions. Additionally, the computing device may access a computer software including a simulation module, wherein the computer software receives the plurality of regions of the contoured surface and the at least one independent regional print path for each region of the plurality of regions, and wherein the simulation module executes a simulation to verify a control plan programmed to control the surface treatment assembly during printing along the contoured surface.

The features, functions, and advantages disclosed herein can be achieved independently in various embodiments or may be combined in yet other embodiments, the details of which may be better appreciated with reference to the following description and drawings.

It should be understood that the drawings are not necessarily to scale, and that the disclosed embodiments are illustrated diagrammatically, schematically, and in some cases in partial views. In certain instances, details which are not necessary for an understanding of the disclosed methods and apparatuses or which render other details difficult to perceive may have been omitted. It should be further understood that the following detailed description is merely exemplary and not intended to be limiting in its application or uses. As such, although the present disclosure is for purposes of explanatory convenience only depicted and described in illustrative embodiments, the disclosure may be implemented in numerous other embodiments, and within various systems and environments not shown or described herein.

DETAILED DESCRIPTION

The following detailed description is intended to provide both devices and methods for carrying out the disclosure. Actual scope of the disclosure is defined by the appended claims.

Figure 1:
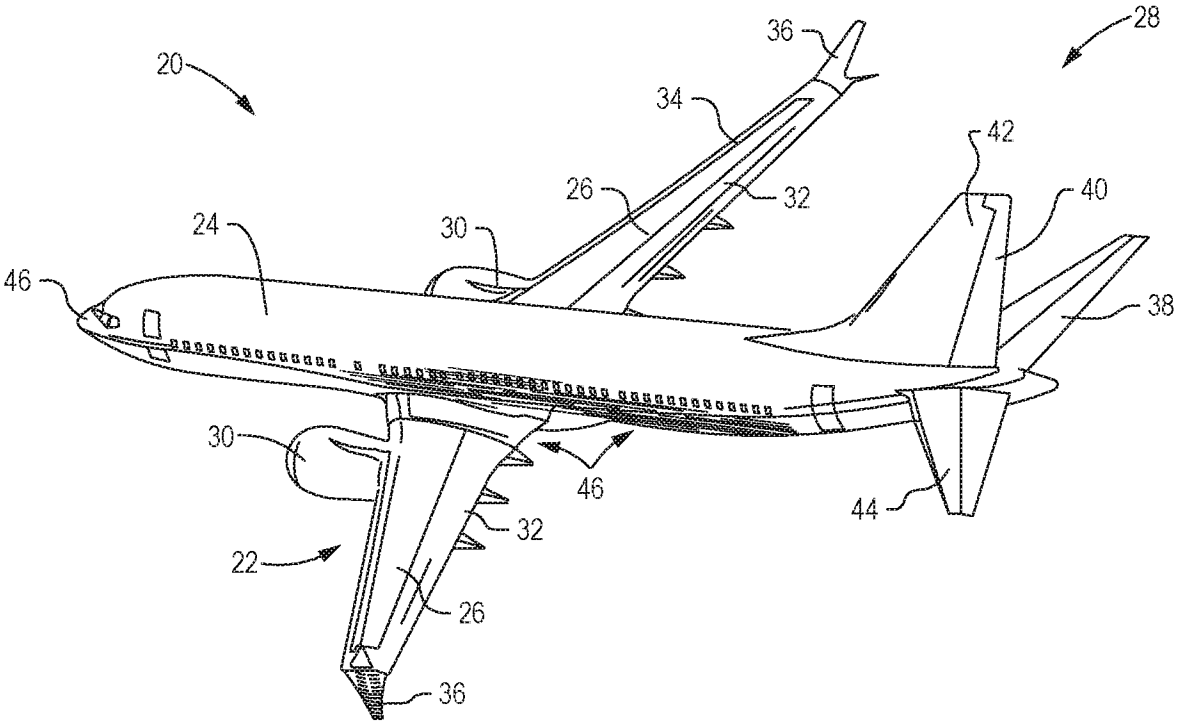
FIG. 1 is a perspective view of an exemplary vehicle constructed in accordance with the present disclosure.

Referring to FIG. 1, a vehicle 20 is illustrated. One non-limiting example of the vehicle 20 is that of an aircraft; however the present disclosure applies to other types of vehicles and machines as well. As illustrated, the vehicle 20 is configured with an airframe 22 which includes a fuselage 24, a pair of wings 26, and a tail section 28. In some embodiments, one or more propulsion units 30 are coupled to each wing 26 in order to propel the vehicle 20 in a direction of travel. Furthermore, the pair of wings 26 is fixedly attached to opposing sides of the fuselage 24 and the propulsion units 30 are attached to an underside surface of each wing 26; however other attachment locations of the propulsion units 30 are possible. In some embodiments, the pair of wings 26 is positioned at a substantially centered position along the fuselage 24, and each wing 26 includes a plurality of flaps 32, leading edge devices 34, and one or more peripheral edge devices 36 (i.e., winglets). Moreover, during operation of the vehicle 20, the flaps 32, leading edge devices 34 and peripheral edge devices 36 are capable of being adjusted in a plurality of positions in order to control and stabilize the vehicle 20. For example, the flaps 32 and leading edge devices 34 are adjustable in several different positions to produce the desired lift characteristics of the wings 26. Additionally, the tail section 28 of the airframe 22 includes components which provide other stability and maneuverability functions of the vehicle 20, such as an elevator 38, a rudder 40, a vertical stabilizer fin 42, and a horizontal stabilizer 44.

Figure 2:
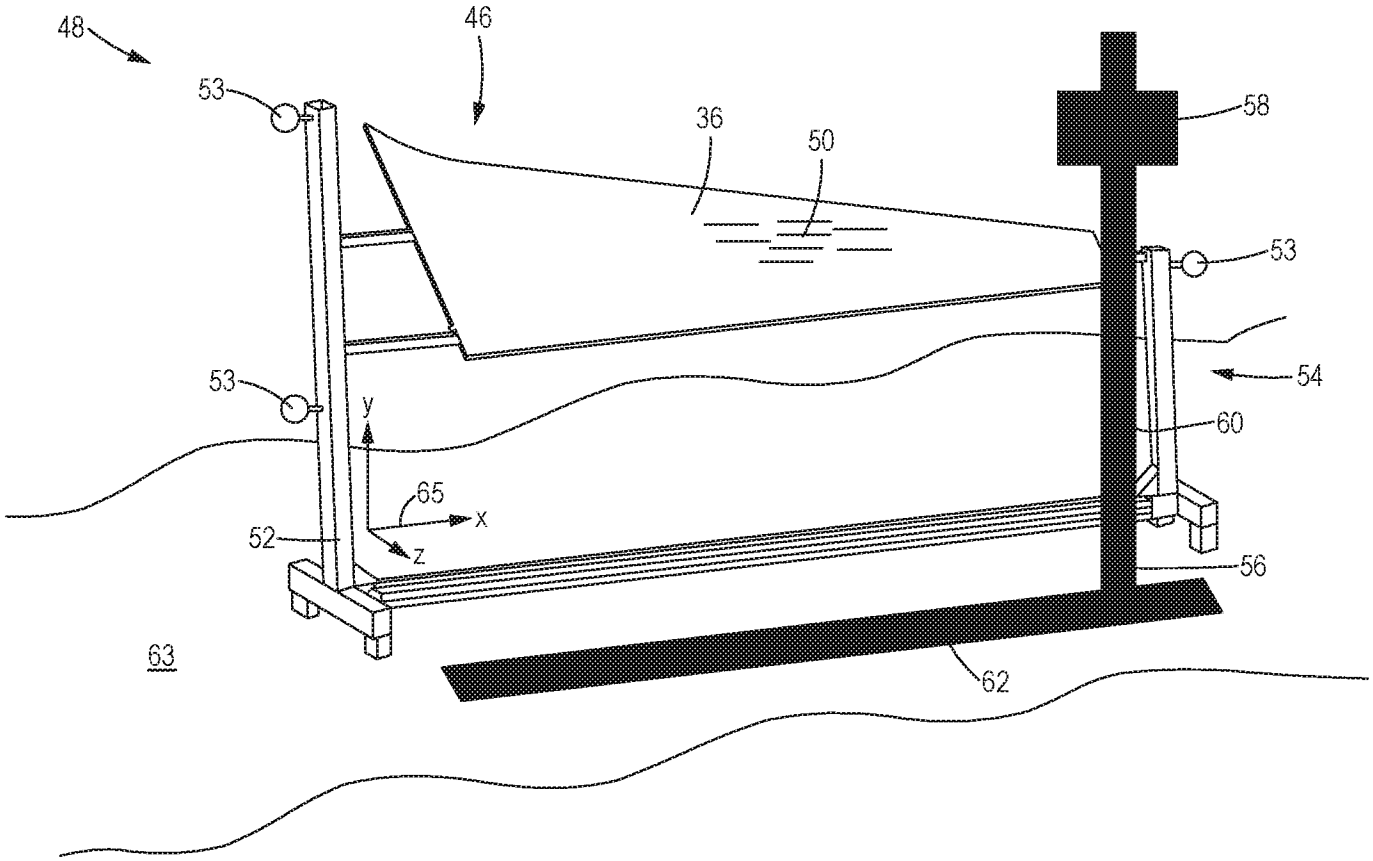
FIG. 2 is a perspective view of an exemplary contoured surface, and surface treatment assembly in accordance with the present disclosure.

FIG. 2 illustrates one non-limiting example of the peripheral edge device 36 that is unattached from the wing 26 (FIG. 1). Generally, the peripheral edge device 36 and other vehicle 20 components shown in FIG. 1, such as but not limited to the fuselage 24, wings 26 and tail section 28 are constructed out of aluminum, aluminum alloy, titanium, carbon composite, or other known material. Moreover, the peripheral edge device 36 includes an aerodynamic shape that exhibits a variety of changing dimensions and topography along the length and width of the structure. Accordingly, the peripheral edge device 36 is often described as having a contoured surface 46 or other such outer surface profile. In one embodiment, the contoured surface 46 defines an outer surface of the peripheral edge device 36 formed by a series of changing surface geometries such as but not limited to, an increase in diameter, a decrease in diameter, a convex surface, a concave surface, or other such surface geometry, profile or combination thereof. While the contoured surface 46 is discussed in connection to the peripheral edge device 36, it will be understood that other vehicle 20 components such as the fuselage 24, the pair of wings 26, the tail section 28 and the propulsion unit 30 include a variety of contoured surfaces similar to the contoured surface 46 as described herein.

As further illustrated in FIG. 2, during manufacture and/or servicing of the vehicle 20 (FIG. 1), one embodiment of the peripheral edge device 36 is positioned within a work area 48 and prepared for one or more manufacturing and/or scheduled service steps. For example, the manufacturing and/or servicing of the peripheral edge device 36 includes implementing one or more surface treatments along the contoured surface 46. Generally, the surface treatment of the contoured surface 46 includes one or more of cleaning, abrading, priming, painting, protecting, repairing, or other such surface treatment applied along the contoured surface 46 of the peripheral edge device 36. In an embodiment, the surface treatment includes applying a decorative livery coating 50, or other such coating, along the contoured surface 46 of the peripheral edge device 36. The decorative livery coating 50 provides surface protection against the harsh environmental conditions encountered by the peripheral edge device 36. Furthermore, the decorative livery coating 50 creates a visible, decorative design along the contoured surface 46 that helps identify and distinguish one vehicle 20 from another. For simplicity the decorative livery coating 50 is discussed only with respect to the peripheral edge device 36, but it will be understood that the contoured surface 46 along other components of the vehicle 20 (FIG. 1), such as the fuselage 24, the pair of wings 26, the tail section 28 propulsion unit 30, or other portion of the vehicle 20 are also coated with the decorative livery coating 50 or other such surface treatment.

In one embodiment, during surface treatment the peripheral edge device 36 is positioned within the work area 48 and supported by a work piece frame 52. The work piece frame 52 provides temporary support for the peripheral edge device 36 so that a surface treatment assembly 54 is able treat the contoured surface 46 with the decorative livery coating 50, or other such surface treatment. Moreover, the work piece frame 52 includes one or more frame targets 53 attached to the work piece frame 52. The frame targets 53 are used as reference points by the surface treatment assembly 54 during the application of the decorative livery coating 50. The frame targets 53 can be used to define a spatial reference model of the work piece frame 52 based on a detection of the frame targets 53. In one non-limiting example, the surface treatment assembly 54 includes an automated robot assembly 56 operably coupled to a print head assembly 58. The automated robot assembly 56 is controlled to position and adjust print head assembly 58 according to the shape and profile of the contoured surface 46. As described above, the contoured surface 46 defines the outer surface of the peripheral edge device 36 which is formed by a series of changing surface geometries such as but not limited to, an increase in diameter, a decrease in diameter, a convex surface, a concave surface, or other such surface geometry, profile or combination thereof. Accordingly, the contoured surface 46 may be additionally defined as a measurable and printable outer surface of vehicle 20 components (e.g., fuselage 24, wing 26, tail section 28 and peripheral edge device 36).

Furthermore, one embodiment of the automated robot assembly 56 includes an actuating arm 60 or other such adjustable support structure that is operably coupled to the print head assembly 58. The actuating arm 60 is further attached to a rail 62 or other such longitudinal translating device that extends along the floor 63 of the work area 48. Accordingly, the automated robot assembly 56 is controlled or otherwise actuated to move the surface treatment assembly 54 along the rail 62 while the decorative livery coating 50 is applied along the contoured surface 46. Additionally, the actuating arm 60 of the automated robot assembly is controlled or otherwise actuated such that the print head assembly 58 maintains a normal orientation, a desired dispense gap and other such processing parameters between the contoured surface 46 and the print head assembly 58. As such, FIG. 2 includes a three-dimensional (3D) axis 65 which represents three axes of movement (i.e., x, y, z) for the automated robot assembly 56 within the work area 48. While the automated robot assembly 56 is shown being coupled to the rail 62, it will be understood that the surface treatment assembly 54 can be alternatively mounted or otherwise attached to an overhead gantry crane (not shown) an automated guided vehicle (AGV) (not shown) or other such actuating device that is configured to move the surface treatment assembly 54 and automated robot assembly 56 along the peripheral edge device 36 or other such vehicle 20 component located in the work area 48.

Figure 3:
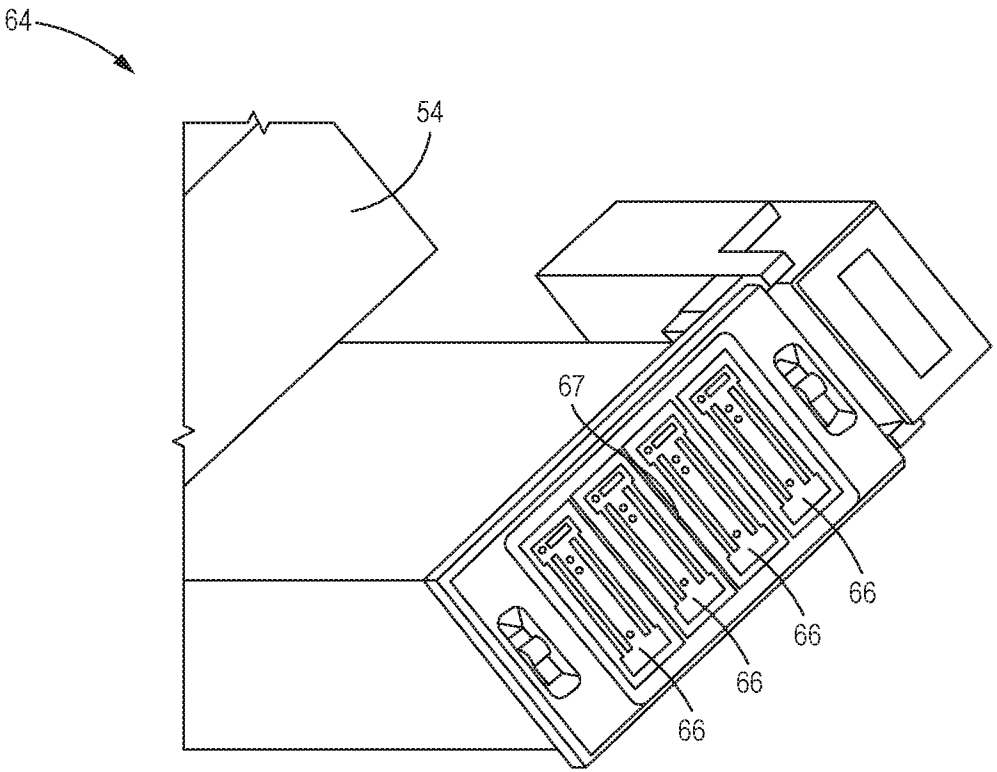
FIG. 3 is a perspective view of an exemplary ink jet print head attached to the surface treatment assembly of FIG. 2, in accordance with the present disclosure.

Referring now to FIG. 3, with continued reference to FIG. 2, an exemplary ink jet print head 64 that is operably attached to the print head assembly 58 is shown. The ink jet print head 64 is configured to dispense the decorative livery coating 50 or other such surface treatment layer along the contoured surface 46. Accordingly, the ink jet print head 64 includes a plurality of ink jet nozzles 66 configured to apply an ink, paint, primer and/or other such surface coating onto the contoured surface 46. Generally, each ink jet nozzle 66 is configured to dispense one color from a group of desired colors. In one non-limiting example the group of colors include cyan (C), magenta (M), yellow (Y), and black (K); however, other colors are possible. Additionally, the ink jet print head 64 includes a tool center point (TCP) 67 that is defined in the center of the print head. The TCP 67 serves as a reference point of the ink jet print head 64 and the print head assembly 58 which is used to help determine the position, orientation dispense gap and other such parameters between the print head assembly 58, the ink jet print head 64, and the contoured surface 46 or other such surface being treated by the surface treatment assembly 54.

Figure 4:
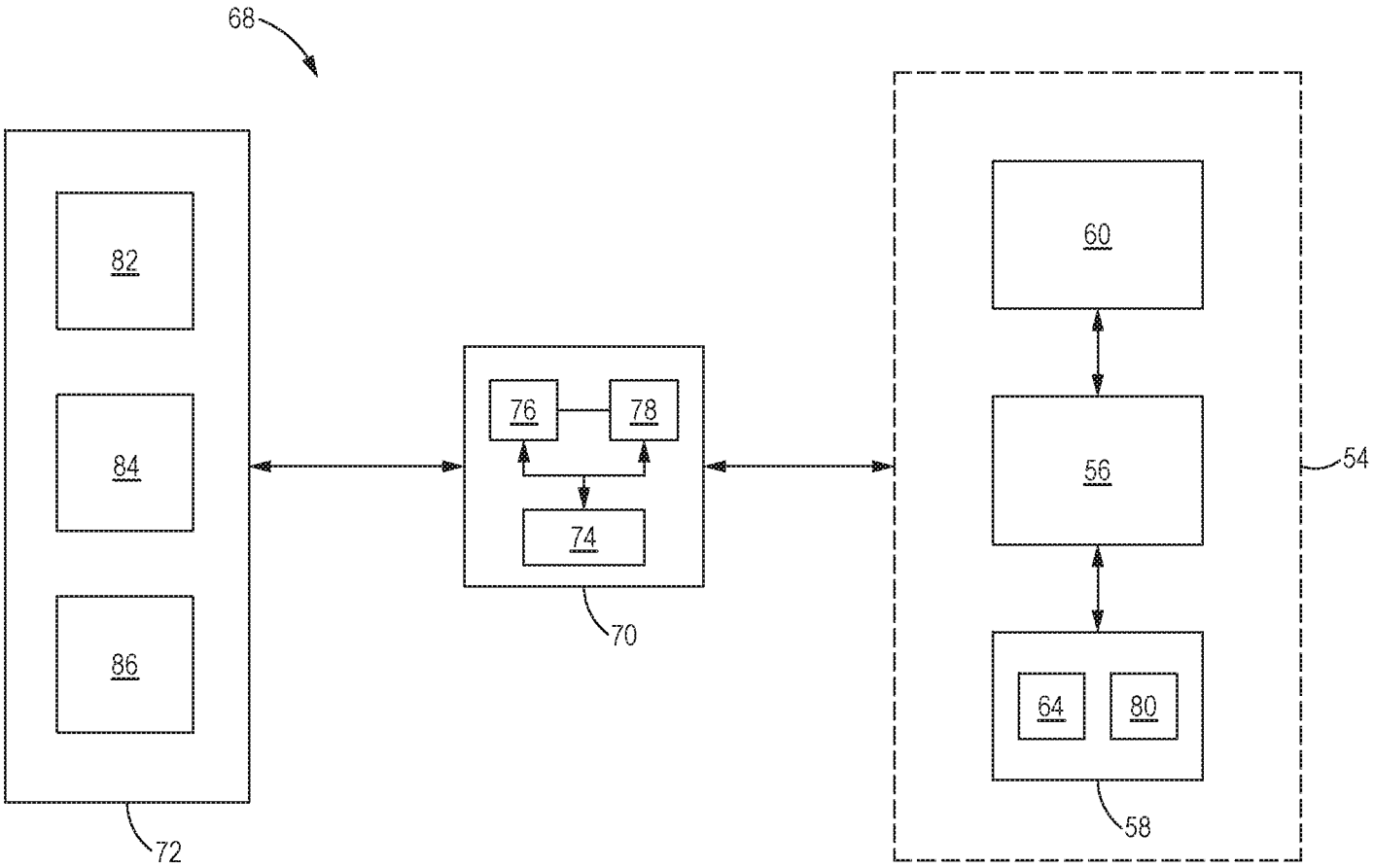
FIG. 4 is a schematic view of a control system for a metrology system and the surface treatment assembly of FIG. 2, in accordance with the present disclosure.

Referring now to FIG. 4, with continued reference to FIGS. 2 and 3, a schematic illustration of an exemplary control system 68 used to operate and control the surface treatment assembly 54 and the automated robot assembly 56 is shown. The control system 68 includes a controller 70 that is communicably coupled to the surface treatment assembly 54. Communication between the controller 70 and surface treatment assembly 54 is established using a radio frequency network, a computer data network, a Wi-Fi data network, a cellular data network, a satellite data network, or other such data communication network. Establishing the communication network between the controller 70 and surface treatment assembly 54 allows the controller to send or otherwise communicate control signals to the surface treatment assembly 54 and automated robot assembly 56 during the application of the decorative livery coating 50. Moreover, in some embodiments, the surface treatment assembly 54 collects data and other information that is sent or otherwise communicated to the controller 70. The controller 70 uses the collected data and other information received from the surface treatment assembly 54 to generate and/or update control signals that are sent from the controller 70 to the surface treatment assembly 54 and automated robot assembly 56. In some cases, the work area 48 is configured with more than one surface treatment assembly 54. As a result, the controller 70 can be configured to control and operate more than one surface treatment assembly 54, as needed.

Additionally, some embodiments of the control system 68 further include a metrology system 72 that is communicably coupled to the controller 70 in a similar fashion as the surface treatment assembly 54, described above. Accordingly, the established communication network (e.g., radio frequency network, computer data network, Wi-Fi data network, cellular data network, satellite data network and the like) between the controller 70 and metrology system 72 allows the controller 70 to send control signals the metrology system 72. Additionally, the controller 70 is capable of receiving signals and data collected by the metrology system 72. The controller 70 may analyze the collected data and use the analysis results to generate and/or update control signals that are sent to the surface treatment assembly 54 and the automated robot assembly 56. For simplicity, FIG. 4 shows the surface treatment assembly 54 and the metrology system 72 each being communicably coupled to the controller 70. However, it will be understood that the surface treatment assembly 54 and the metrology system 72 may each be communicably coupled to a separate controller (not shown but similarly configured as controller 70) programmed to specifically control and operate the surface treatment assembly 54 or the metrology system 72.

As further illustrated in FIG. 4, the controller 70 includes an input/output module 74 which provides an operator or other interested personnel access to the controller 70. For example, the input/output module 74 is configured with an input device such as but not limited to, a keyboard, mouse, dial, wheel, button, touch screen, microphone, or other input device. The operator can use the input device of the input/output module 74 to enter or otherwise execute commands and instructions to be performed by the controller 70. Additionally, the input/output module 74 is configured with an output device such as but not limited to a monitor, screen, speaker, printer, or other output device. As a result, data and other information that is generated by the controller 70 can be output to the operator by the output device of the input/output module 74.

Additionally, in an embodiment, the controller 70 further includes a processor module 76 and a memory module 78. The memory module 78 includes a non-transient computer-readable medium such as random access memory (RAM) read only memory (ROM) or other memory structure. In some embodiments, computer-executable instructions (i.e., software) are stored by the memory module 78. Furthermore, the processor module 76 executes computer-implemented tasks of the controller 70 by retrieving the computer-executable instructions from the memory module 78 and executing the computer-executable instructions on a device processor contained in the processor module 76.

As discussed above, the controller 70 is communicably coupled to the surface treatment assembly 54 and programmed to transmit operational commands during operation of the surface treatment assembly 54. Accordingly, the controller 70 is also configured to transmit operational control signals to the automated robot assembly 56 to move the print head assembly 58, the actuating arm 60 and other components of the surface treatment assembly 54. For example, the controller 70 sends one or more control signals to the surface treatment assembly 54 which subsequently actuates the actuating arm 60 of the automated robot assembly 56 to position and orient the print head assembly 58 relative to the contoured surface 46 of the peripheral edge device 36 or other contoured structure to be treated.

Moreover, the automated robot assembly 56 has one or more actuating devices (not shown) that articulate the actuating arm 60 of the automated robot assembly 56 and provide locomotion of the automated robot assembly 56 along the rail 62. As a result, control signals sent between the controller 70 and surface treatment assembly 54 further include actuation and/or locomotion commands for the actuating devices (not shown) which move the automated robot assembly 56, and adjust and/or orient the print head assembly 58 relative to the contoured surface 46 (FIG. 2). In one non-limiting example, the actuating devices (not shown) are controlled such that the automated robot assembly 56 continuously adjusts and orients the position of the print head assembly 58 to maintain a normal orientation and proper dispense gap relative to the contoured surface 46 (FIG. 2). Additionally, the control signals from the controller 70 include commands to activate and/or deactivate individual ink jet nozzles 66 of the ink jet print head 64 in order to dispense or otherwise apply the decorative livery coating 50 along the contoured surface 46 (FIG. 2).

In an embodiment, the print head assembly 58 further includes one or more sensors 80 configured to scan and collect data during operation of the surface treatment assembly 54. In one non limiting example, the sensor 80 includes a surface scanning laser configured to scan and collect surface topography data of the contoured surface 46 and the surrounding areas. As such, the sensor 80 scans the contoured surface 46 (FIG. 2) to collect metrology and other surface profile data, such as but not limited to, surface roughness data, surface imaging data, location/positioning data, height sense data, angular orientation data, and any other such surface data. This data is transmitted or otherwise sent back to the controller 70 for analysis. In some embodiments, the controller 70 generates and/or updates control signals for the surface treatment assembly 54 in real-time based off the data collected by the sensor 80 and the subsequent data analysis performed by the controller 70. Additionally or alternatively, data collected by the sensor 80 is stored in the memory module 78, and analyzed at a later time. It will be understood that laser scanning sensors are one type of data collecting device that is used as the sensor 80 to be used; however, other types of sensors and/or combinations thereof, such as an interferometer, a capacitive transducer, an ultrasound transducer, a camera, or other such sensor, can be incorporated with the automated robot assembly 56 or other component of the surface treatment assembly 54, and configured to collect data used to adjust and control the surface treatment assembly 54.

As discussed above, an embodiment of the control system 68 includes the controller 70 being further communicably coupled to the metrology system 72. The metrology system 72 includes a plurality of sensors that scan the contoured surface 46 of the peripheral edge device 36 (FIG. 2) or other structure that is being treated by the surface treatment assembly 54. In one non-limiting example, the metrology system 72 includes one or more vision data sensors 82, such as a digital camera or other such vision sensor, one or more distance data sensors 84, such as a time of flight camera, a LIDAR sensor or other such distance measurement sensor, one or more topography sensors 86, such as an interferometer, a profilometer or other such surface topography sensor. Accordingly, the metrology system 72 collects a variety of data related to the contoured surface 46 of the peripheral edge device 36 or other such component to be treated by the surface treatment assembly 54. For example, the sensors 82, 84, 86 included in the metrology system 72 scan the contoured surface 46 prior to treatment by the surface treatment assembly 54 and collect a multi-dimensional set of data points related to the peripheral edge device 36 that is attached to the work piece frame 52 and positioned within the work area 48. Additionally, the sensors 82, 84, 86 of the metrology system 72 scan and detect the one or more frame targets 53 attached to the work piece frame 52. As a result, the data collected from detection of the one or more frame targets 53 can be used by the control system 68 to define a spatial reference model of the work piece frame 52 based on a detection of the frame targets. Accordingly, the spatial reference model can be used to determine a location of the work piece frame 52 within the work area 48.

Figure 5:
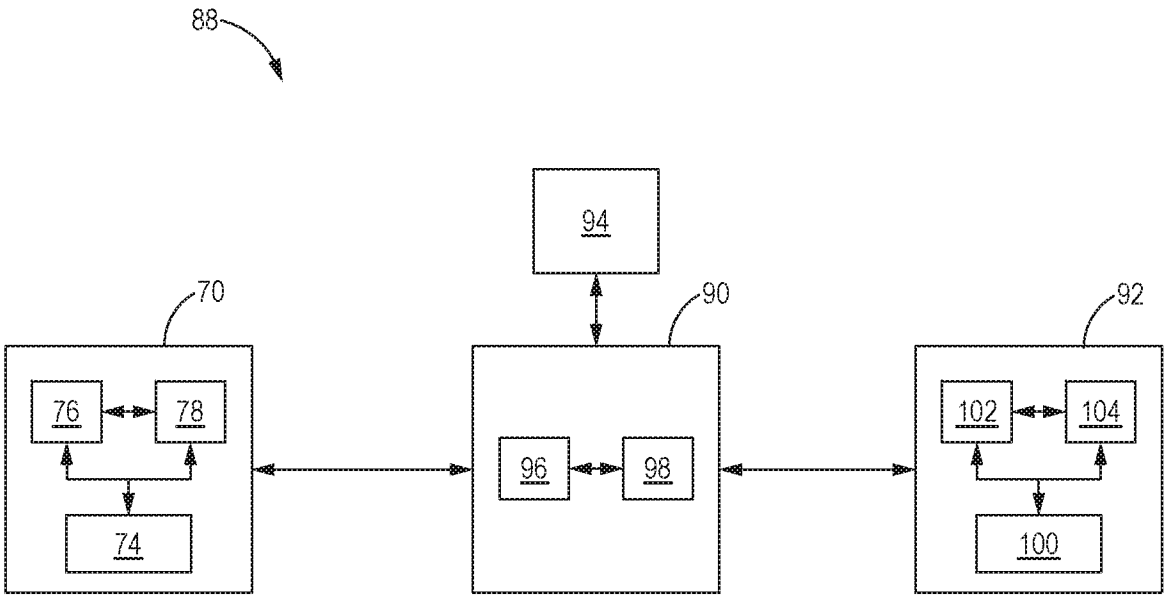
FIG. 5 is a schematic view of a computer device network, in accordance with the present disclosure.

Referring now to FIG. 5, a schematic of a computer device network 88 used to develop, program, simulate, and transmit control plans for the surface treatment assembly 54 and the metrology system 72 (FIGS. 2 and 4), is shown. Additionally, the computer device network 88 is used to analyze the surface data set collected by the sensors 82, 84, 86 of the metrology system 72 (FIG. 4), as well as data collected from sensor 80 on the print head assembly 58 and other data such collected by the surface treatment assembly 54. In one non-limiting example, the computer device network 88 includes a network server 90, a computing device 92 (i.e., desktop computer, laptop computer, tablet, or smartphone), and the controller 70. As such, the computer device network 88 is configured to create a communication network in which the network server 90, the computing device 92 and the controller 70 are communicably coupled with one another. Communication between the network server 90, computing device 92, and controller 70 is established using a radio frequency network, a computer data network, a Wi-Fi data network, a cellular data network, a satellite data network, or other such data communication network. In some embodiments, the network server 90 is configured as a centralized computing and communication device that facilitates the sending and receiving of data from each of the computing device 92 and controller 70; however other configurations of the computer device network are possible.

Furthermore, the network server 90 is coupled to a network database 94 that stores data and information related to the control and operation of the surface treatment assembly 54, the metrology system 72 and other components of the control system 68. The network database 94 includes data and information such as but not limited to, surface metrology data, image or design data of the decorative livery coating 50 to be printed, print head data, print control plan data, and other such data. Moreover, the network server 90 and network database 94 are configured such that the data stored in the network database 94 is accessible to the computing device 92, the controller 70 and other such networked devices. Additionally, data collected by the print head sensor 80, vision data sensor 82, distance data sensor 84, topography sensor 86 (FIG. 4), and other such sensors, can be sent to the network server 90 from the controller 70. In some embodiments, the network server 90 receives the data for analysis by the network server 90 and/or computing device 92. Alternatively, the network server 90 sends the data received from the controller 70 to be stored in the network database 94 for later reference and analysis.

The network server 90 further includes at least one server processor module 96 that is communicably coupled to a server memory module 98 to perform various network tasks such as but not limited to, facilitating communication between the computing device 92, the controller 70, the surface treatment assembly 54, and the metrology system 72. Additionally, the server processor module 96 executes computer-related instructions for managing and storing data, analyzing data, generating control plans and other such tasks. Generally, the server processor module 96 is configured to execute instructions provided by one or more computer programs stored in the server memory module 98. The server memory module 98 includes a non-transient computer-readable medium such as but not limited to, random access memory (RAM) read-only memory (ROM) and other such memory devices. As a result, the computer program provides a set of instructions executed by the network server 90 in order to perform one or more tasks over the computer device network 88.

Furthermore, the computing device 92 includes a computing device input/output module 100, a computing device processor module 102, and a computing device memory module 104. In some embodiments, the computing device input/output module 100 is configured with an input device such as but not limited to, a keyboard, mouse, dial, wheel, button, touch screen, microphone, or other input device. Additionally, the input/output module 100 is configured with an output device such as but not limited to a monitor, screen, speaker, printer, or other output device. As a result, a user can input commands and instructions to be performed by the computing device 92, and, view data and other information that is generated by the computing device 92. Additionally, in an embodiment, the computing device processor module 102 is configured to execute instructions outlined in computer software stored in the computing device memory module 104. The computing device processor module 102 and computing device memory module 104 are communicably coupled to one another such that the computing device processor module 102 retrieves and executes the instructions and/or other such data stored on the computing device memory module 104. Moreover, data and other information generated from the execution of instructions by the computing device processor module 102 can be stored on the computing device memory module 104. Generally, the computing device memory module 104 is a computer hardware device capable of repeated memory retrieval and/or storage such as random access memory (RAM), read-only memory (ROM), flash memory, hard disk drive, solid state disk drive, or other such memory device.

In some embodiments, the network server 90 and the computing device 92 work together to analyze data and information in order to generate a control plan for the surface treatment assembly 54 (FIG. 2). Additionally, the network server 90 and/or computing device 92 perform one or more simulations during the programming of the control plan because treatment of the contoured surface 46 along the peripheral edge device 36 (FIG. 2) is a complicated process. One or more simulations can be run by the network server 90 and/or computing device 92 to test and verify the generated control plan to be executed by the surface treatment assembly 54 (FIGS. 2 and 3). The simulation results can be further analyzed using the network server 90 and/or computing device 92 to confirm the devised control plan will accurately apply the decorative livery coating 50 (FIG. 2) or other surface treatment to the contoured surface 46 (FIG. 2). Additionally, the simulation results can be used by the network server 90 and computing device 92 to revise and improve the control plan to correct any control plan errors detected during the simulation.

Figure 6:
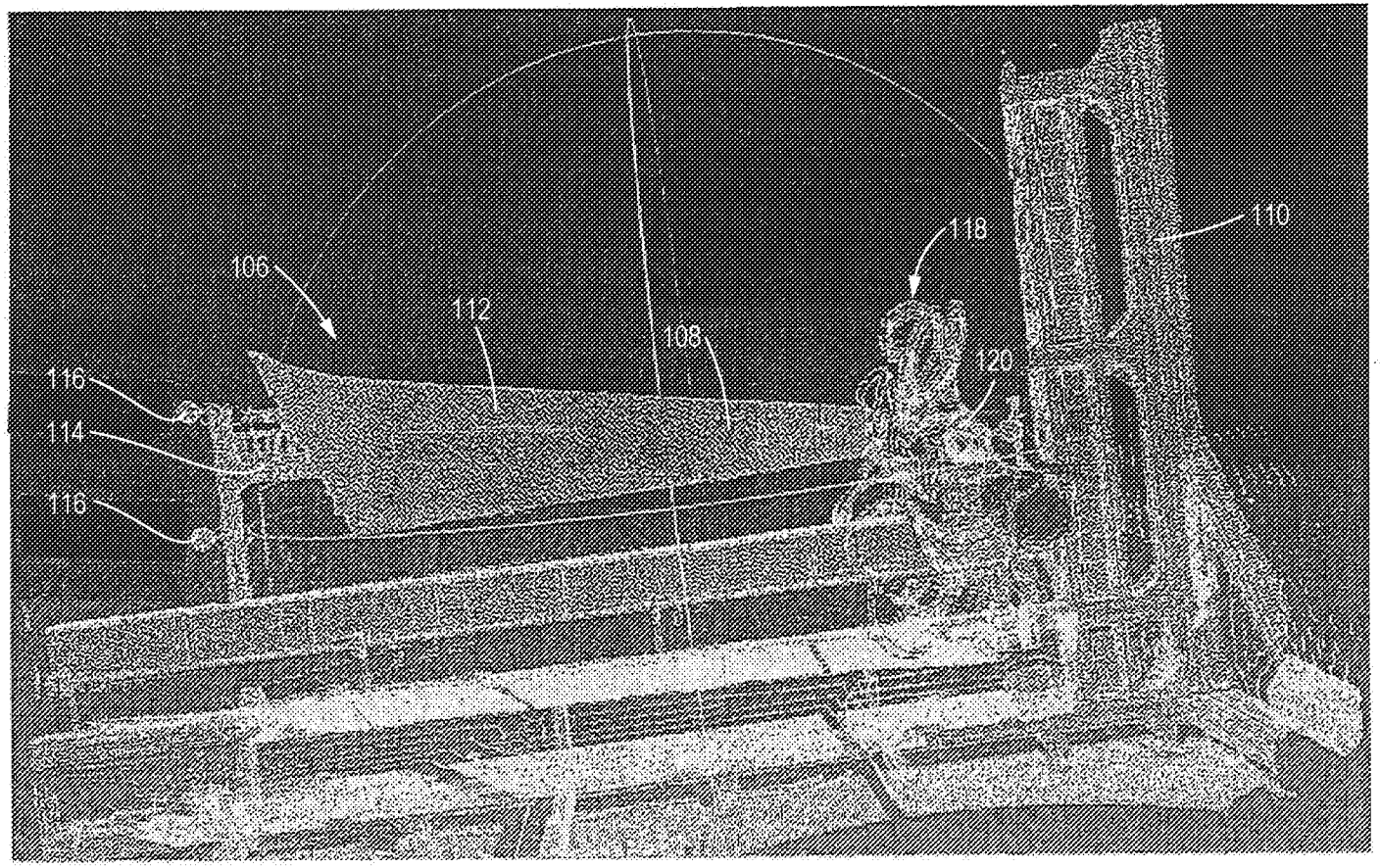
FIG. 6 is a perspective view of a point cloud model generated using data collected by the metrology system of FIG. 4, in accordance with the present disclosure.

In one exemplary embodiment, the network server 90 and/or computing device 92 are further programmed to analyze the multi-dimensional data set collected by the metrology system 72 (FIG. 4). The multi-dimensional data set includes a series of data points which represent the contoured surface 46 of the peripheral edge device 36, the surface treatment assembly 54, the work piece frame 52 (FIG. 2), and other structures or components scanned by the metrology system 72. As illustrated in FIG. 6, one non-limiting example of the multi-dimensional data set is that of a three-dimensional (3D) point cloud model 106 generated or otherwise constructed by the network server 90 and/or computing device 92. The 3D point cloud model 106 assembles the multi-dimensional data set collected by the metrology system 72 into a multi-dimensional digital illustration of the surface treatment assembly 54, the peripheral edge device 36 and the work piece frame 52. The 3D point cloud model 106 is generated by the network server 90 and/or computing device 92 following a data analysis performed on the collected multi-dimensional data set.

As further illustrated in FIG. 6, the 3D point cloud model 106 includes a high resolution digital model displayed on the computing device input/output module 100 or other such display device. As used herein, the term point cloud model refers to a digital image or illustration formed from a set of data points residing in space and the set of data points is generated by the network server 90, the computing device 92 or other such computing device. In one non-limiting example, the 3D point cloud model 106 includes a peripheral edge device point cloud image 108 and a surface treatment assembly point cloud image 110. The peripheral edge device point cloud image 108 further includes a surface topography or surface contour 112 of the contoured surface 46, as scanned by the metrology system 72. Moreover, the surface treatment assembly point cloud image 110 includes a work piece frame point cloud image 114, a frame target point cloud image 116, an automated robot assembly point cloud image 118, print head assembly point cloud image 120 and other point cloud images of components of the surface treatment assembly 54 which are scanned by the metrology system 72. In one non-limiting example, the 3D point cloud model 106 is generated to provide an accurate model that captures and confirms the as-built dimensions of the peripheral edge device 36 or other such component of the vehicle 20. Such confirmation is important because due to certain manufacturing tolerances and other such limitations the as-built dimensions may not always match the as-designed dimensions. Accordingly, the 3D point cloud model 106 allows for a comparison between the as-built and as-designed dimensions prior to treatment of the contoured surface 46 by the surface treatment assembly 54. Furthermore, the work piece frame point cloud image 114 allows for the generation of a spatial reference model based on the detection of at least one of the frame targets 53.

Figure 7:
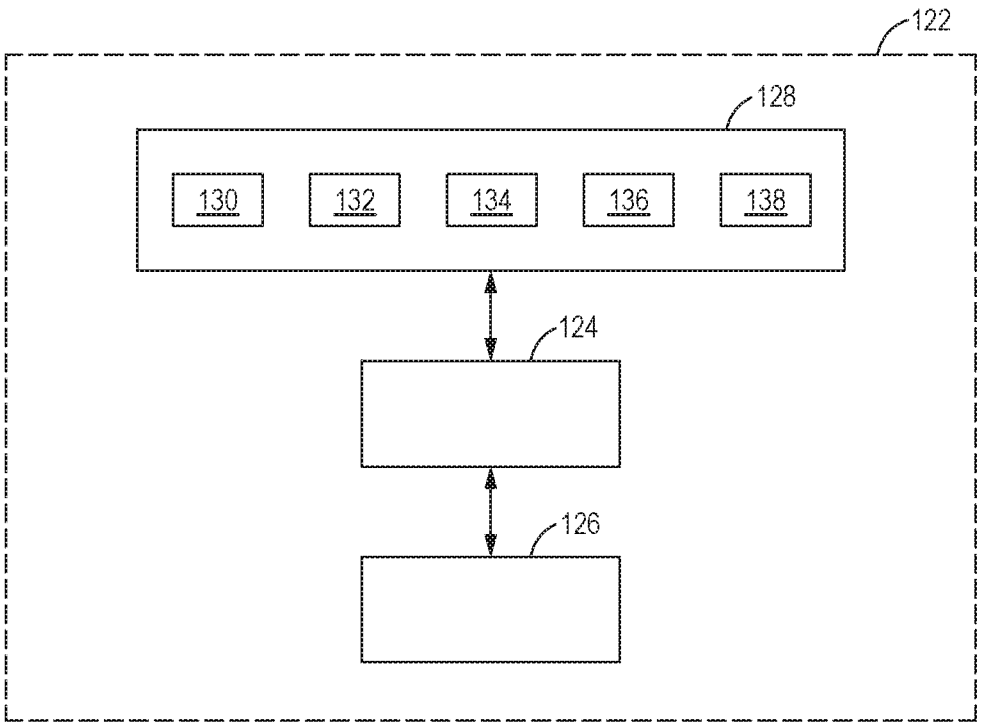
FIG. 7 is a schematic view of a computer program executed on the computer device network of FIG. 5, in accordance with the present disclosure.

Referring now to FIG. 7, a schematic is shown of an exemplary computer software 122 used for programming, simulating and confirming a control plan for the surface treatment assembly 54. The computer software 122 may be stored or otherwise located in the server memory module 98 of the network server 90 and/or the network database 94. As such, the computing device 92 or other such computing device accesses the computer software 122 on the network server 90 over the computer device network 88. Alternatively, the computer software 122 is additionally and/or alternatively stored locally on the computing device memory module 104 of the computing device 92. Accordingly, the user can activate and operate the computer software 122 directly from the computing device 92 by way of the computing device input/output module 92. In an embodiment, the computer software 122 is programmed to perform a simulation 124 of the surface treatment assembly 54 application of the decorative livery coating 50 (FIG. 2), or other surface treatment, along the contoured surface 46 (FIG. 2) of the peripheral edge device 36 (FIG. 2). The simulation 124 results are then analyzed by the computer software 122 to generate or otherwise program a control plan 126. The control plan 126 is programmed to provide a set of instructions that are sent to and executed by the controller 70 (FIG. 4) to control the surface treatment assembly 54 (FIGS. 2 and 4) during the treatment of the contoured surface 46 (FIG. 2). Additionally and/or alternatively, the simulation 124 results are used to validate and/or update a previously devised control plan 126 for the surface treatment assembly 54 and the computer software 122 generates an updated or corrected control plan 126.

In an embodiment, the computer software 122 receives one or more input parameters 128 that are used by the computer software 122 during the simulation 124. The input parameters 128 are entered, or otherwise input, into the computer software 122 using the computing device input/output module 100. Alternatively, the input parameters 128 are stored in the network database 94 (FIG. 4), or other location of the computer device network 88 (FIG. 5). As such, the input parameters 128 are imported or uploaded into the computer software 122, as needed to run the simulation 124. Generally, the input parameters 128 include information related to the surface treatment assembly 54 (FIGS. 2 and 4) and the contoured surface 46 (FIG. 2); however, the input parameters 128 can be configured to include other information and data needed to complete the simulation 124. For example, one such input parameter 128 used by the computer software 122 is the print profile 130. In some embodiments, the print profile 130 defines the desired resolution, in dots per inch (DPI), of the decorative livery coating 50 (FIG. 2) to be applied to the contoured surface 46 (FIG. 2). Additionally, the input parameters 128 include a dispense gap 132 that is entered into the computer software 122. The dispense gap 132 defines an acceptable range for the standoff (i.e., minimum and maximum distance) between the print head assembly 58 (FIG. 2) and the contoured surface 46 (FIG. 2). Moreover, a three-dimensional (3D) model 134 of the print head assembly 58 (FIG. 2) is entered or otherwise provided as one of the input parameters 128. In an embodiment, the 3D model 134 of the print head assembly 58 is based off the 3D point cloud model 106 (FIG. 6) that is generated from the multi-dimensional data set collected by the metrology system 72. As such, the user loads or imports the 3D model 134 of the print head assembly 58 into the computer software 122. Alternatively, the metrology system 72 (FIG. 4) can be used to scan the surface treatment assembly 54 and print head assembly 58 to generate the 3D point cloud model 106. The 3D model 134 of the print head assembly 58 can be obtained from the print head assembly point cloud image 120, or other portion of the 3D point could model 106, and imported into the computer software 122.

Furthermore, the input parameters 128 include a 3D surface mesh or scan 136 of the contoured surface 46 (FIG. 2) that is entered into the computer software 122. As mentioned above, the contoured surface 46 (FIG. 2) is formed by a series of changing surface geometries such as but not limited to, an increase or decrease in diameter, a convex surface, a concave surface, or other such surface geometry, profile or combination thereof. As such, the 3D surface mesh 136 provides an accurate contour map that includes the as-built location and dimensions of vertices, edges and faces which define the surface profile of the contoured surface 46 (FIG. 2). The 3D surface mesh 136 is incorporated into the simulation 124 by the computer software 122 in order to confirm that the control plan 126 correctly directs and controls the movement of the surface treatment assembly 54 along the contoured surface 46 during application of the decorative livery coating 50 (FIG. 2). Similar to the 3D model 134 of the print head assembly 58, the 3D surface mesh 136 can be obtained from the 3D point cloud model 106. More specifically, the 3D surface mesh 136 can be obtained from the peripheral edge device point cloud image 108 and/or the surface topography 112 of the contoured surface 46 and imported into the computer software 122.

As mentioned above, applying the decorative livery coating 50 along the contoured surface 46 requires accurate placement of ink droplets dispensed from the ink jet print head 64 (FIG. 3). An unintended offset of 0.1 millimeters between the print head assembly 58 and contoured surface 46 can have a negative impact on quality of the decorative livery coating 50. Furthermore, the dispense gap or standoff between the ink jet print head 64 and the contoured surface 46 is 5 millimeters or less. Such strict tolerances increase the importance of print path planning to ensure the print head assembly 58 is positioned properly relative to the contoured surface 46. Accordingly, the simulation 124 performed by the computer software 122 uses the dispense gap 132, the 3D model 134 of the ink jet print head 64, and the 3D surface mesh of the contoured surface 46 to confirm that the print head assembly 58 does not contact the contoured surface 46 (FIG. 2). Additionally, such input parameters 128 assist the simulation 124 to predict whether the decorative livery coating 50 (FIG. 2) is properly applied to the contoured surface 46 of the peripheral edge device 36 (FIG. 2). In cases where the simulation 124 identifies issues with the control plan, the computer software 122 provides a corrective action based on the simulation results and modifies to the control plan using the specific input parameters 128 input into the computer software 122.

Referring back to FIG. 4, with continued reference to FIG. 7, the print head assembly 58 and/or the surface treatment assembly 54 includes one or more sensors 80 configured to scan the contoured surface 46 (FIG. 2). In one non-limiting example, the sensor 80 is a surface scanning laser configured to scan and collect surface topography and surface profile data such as but not limited to, surface roughness, surface imaging data, location/positioning data, height sense data, angular orientation data, and other surface profile data of the contoured surface 46 and the surrounding areas. As a result, in an embodiment, the one or more sensors 80 is used to scan the contoured surface 46 (FIG. 2) to provide the 3D surface mesh 136 for the input parameters 128 entered into the computer software 122. Accordingly, the one or more sensors 80 may be used to supplement or in place of the multi-dimensional data set collected by the metrology system 72. It will be understood that while laser scanning sensors are one type of sensor 80 to be used, other sensors and/or a combination different sensors, such as an interferometer, a capacitive transducer, a camera, or other such sensor, can be incorporated with the ink jet print head 64 and/or surface treatment assembly 54. Moreover, as discussed above, the 3D surface mesh 136 can be defined from the 3D point cloud model 106 generated from data collected by the metrology system 72.

Additionally, the input parameters 128 illustrated in FIG. 6 include a two-dimensional (2D) image file 138 that is entered into the computer software 122. In one non-limiting example, the 2D image file 138 includes the design of the decorative livery coating 50 (FIG. 2) to be applied along the contoured surface 46 (FIG. 2). During the simulation 124, the computer software 122 overlays or superimposes the 2D image file 138 onto the 3D surface mesh 136 of the contoured surface 46 (FIG. 2) to be treated.

Furthermore, upon completion of the simulation 124, the computer software 122 outputs the control plan 126 used by the controller 70 (FIGS. 4 and 5) or other such controlling device to operate the surface treatment assembly 54 (FIG. 4). In one non-limiting example, the control plan 126 is communicated over the computer device network 88 of FIG. 5. Alternatively, the control plan 126 is loaded onto the network database 94 and the control plan 126 is accessed using the controller 70 by a user of the surface treatment assembly 54 (FIGS. 4 and 5).

Figure 8:
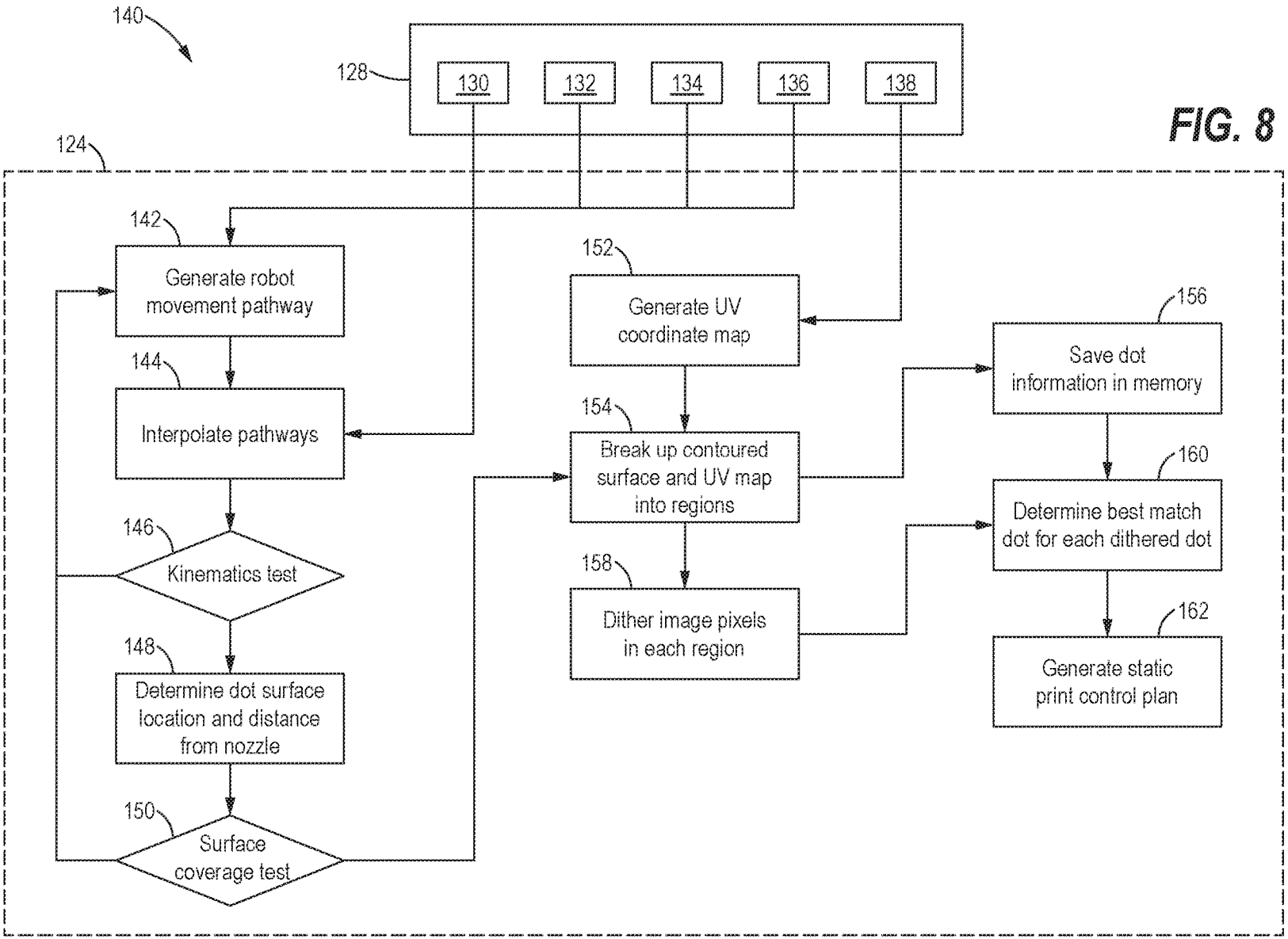
FIG. 8 is a flow chart of a simulation module of the computer program of FIG. 6, in accordance with the present disclosure.

Referring now to FIG. 8, with continued reference to FIGS. 1-7, a method 140 of performing the simulation 124 is shown. In some embodiments, the simulation 124 is run by the computing device 92 and/or network server 90 to generate and optimize the control plan 126 that is programmed to operate and control the surface treatment assembly 54. In a first block 142, the dispense gap 132, 3D model 134 of the print head assembly 58, and the 3D surface mesh 136 are provided as input parameters 128 and used by the simulation 124. The simulation 124 further analyzes the dispense gap 132, the 3D model 134 of the print head assembly 58, and the 3D surface mesh 136 in order to generate a series of movement pathways for the automated robot assembly 56. The movement pathways for the automated robot assembly 56 are based on of the data and information provided by the input parameters 128; however, additional information can be provided by the user that the automated robot assembly 56 will follow during treatment of the contoured surface 46.

Additionally, in block 144, the print profile 130 information from the input parameters 128 is combined with the movement pathways for the automated robot assembly 56 that were generated in block 142. The print profile 130 information includes the specified or desired resolution for the decorative livery coating 50 to be applied along the contoured surface 46. The resolution (i.e., DPI) specified in the print profile 130 is used to interpolate or modify the specified movement pathways for the automated robot assembly 56. As a result, the decorative livery coating 50 will be applied with the desired resolution as the surface treatment assembly 54 prints along the contoured surface 46.

In a next block 146, the simulation 124 performs a robot kinematics test to evaluate the generated movement pathways of the automated robot assembly 56. The robot kinematics test is configured to confirm that the automated robot assembly 56 moves according to the generated movement pathways. Furthermore, the simulation 124 confirms that the generated movement pathways, to be executed by the automated robot assembly 56, will be executed without issue. For example, during the application of the decorative livery coating 50 the print head assembly 58 is positioned adjacent to the contoured surface 46 and the robot kinematics test confirms that the proposed movement pathways do not cause any collisions between the surface treatment assembly 54 and the contoured surface 46 of the peripheral edge device 36 or other structure being treated.

In an embodiment, if the kinematics test performed in block 146 is not passed, the simulation 124 returns back to block 142 to optimize and regenerate the movement pathways for the automated robot assembly 56. In one non-limiting example, the results of the failed kinematics test produced in block 146 will be analyzed by the computer software 122 during the regeneration of movement pathway in attempt to optimize the movement pathway for the automated robot assembly 56. Additionally or alternatively, the user can be notified of the failed kinematics test in block 146. The user can then analyze the results and edit the movement pathways accordingly. Once the portion of the simulation 124 passes the robot kinematics test performed in block 146, the simulation 124 will proceed on to a next block 148.

In block 148, each step or indexed movement the automated robot assembly 56 makes along the movement pathway is further analyzed to determine the location of a dot to be dispensed from the print head assembly 58. As discussed above, an embodiment of the print head assembly 58 includes an ink jet print head 64 with a plurality of ink jet nozzles 66, and each ink jet nozzle 66 of the ink jet print head 64 is configured to dispense a specific color of ink. Generally, the ink jet nozzles 66 are configured to dispense one color from a group of desired colors. One non limiting example of the group of colors includes cyan (C), magenta (M), yellow (Y), and black (K); however the ink jet nozzles 66 can be configured to dispense other colors as needed or desired. Furthermore, the 3D model 134 of the print head assembly 58 includes dimensions of the ink jet print head 64 being included in the input parameters 128 and referenced by the computer software 122. Furthermore, in some embodiments, the input parameters 128 include the definition of the TCP 67 of the ink jet print head 64 (FIG. 3). As a result, the simulation 124 can use the defined the ink jet print head 64 TCP 67 to determine the location of each ink jet nozzle 66. Furthermore, the defined TCP 67 allows the computer software 122 to compute or otherwise determine the shoot direction of each ink jet nozzle 66 relative to the TCP 67 of the ink jet print head 64. In some embodiments, the incorporation of the ink jet nozzle 66 location information and ink jet nozzle 66 shoot direction information allows the simulation 124 to predict, monitor and analyze the location of each dot to be dispensed from the ink jet print head 64.

Furthermore, each dot distance between the contoured surface 46 and the respective ink jet nozzle 66 of the ink jet print head 64 is predicted, monitored, and analyzed at each step or index the automated robot assembly 56 makes along the movement pathway. In some embodiments, the calculated distance between each dot and ink jet nozzle 66 can be compared to the dispense gap 132 range (i.e., minimum and maximum) that was defined or otherwise entered as one of the input parameters 128. As a result, the simulation 124 further confirms that the distance between each dot on the contoured surface 46 and the ink jet nozzle 66 corresponds with the minimum and maximum distance defined by the dispense gap 132.

In a next block 150, the simulation 124 performs a surface coverage test to determine the surface coverage of each dot to be dispensed along the contoured surface 46. During the surface coverage test, the dot coverage is analyzed independent of the desired image (i.e., decorative livery coating 50) that is to be printed along the contoured surface 46. As such, the simulation 124 checks for the correct dot location on the contoured surface 46. Furthermore, the surface coverage test performed is configured to confirm the correct dot distance between each nozzle and the contoured surface 46 that was calculated in the previous block 148. If the dot coverage on the contoured surface 46 does not pass the surface coverage test, then the simulation 124 returns back to block 142 to repeat the generation of movement pathways for the automated robot assembly 56 and the subsequent defined steps of the simulation 124. In some embodiments, the computer software 122 references and uses the results obtained during the surface coverage test, and other portions of the simulation 124, to update some of the input parameters 128 or other such data used by the computer software 122. As a result, one or more corrective actions is performed by the computer software 122 in order to help the simulation 124 pass both the kinematics test performed in block 146 and the surface coverage test performed in block 150.

Furthermore, the simulation 124 includes analyzing the 3D surface mesh 136 of the contoured surface 46 and the 2D image file 138 (i.e., decorative livery coating 50) that are input into the computer software 122. In some cases, printing the decorative livery coating 50 such that it is properly displayed on the peripheral edge device 36 is difficult because of the changing surface profile and geometry (i.e., convex, concave, increasing/decreasing diameter) encountered by the surface treatment assembly 54 as it moves along the contoured surface 46. As a result, in block 152, a UV coordinate map is generated by the computer software 122 or other such computer program. Generally, the UV coordinate map is produced by projecting the 2D image (i.e., decorative livery coating 50, 2D image file 138) onto a 3D surface (i.e., contoured surface 46, 3D surface mesh 136). Moreover, creation of the UV coordinate map permits the 3D object (i.e., 2D image file 138 projected on the 3D surface mesh 136 of contoured surface 46) to be broken up into several polygons, or other such shapes. As a result, in some embodiments, the UV coordinate map is used by the simulation 124 to evaluate how the 2D image file 138 appears after it is overlaid and mapped across the 3D surface mesh 136 of the contoured surface 46.

Referring back to block 150, once the surface coverage test for the dots is passed, then in a next block 154, the simulation 124 proceeds to continue processing the UV coordinate map, generated in block 152, by breaking up the 3D surface mesh 136 of the contoured surface 46 and the 2D image file 138 into multiple regions or mesh faces. As discussed above, 3D surface mesh 136 provides a surface profile of the portion of the contoured surface 46 intended to be treated by the surface treatment assembly 54. Often times, this includes a large surface area and in order to make the printing process more manageable the computer software 122 breaks up the 3D surface mesh 136 into a plurality of smaller polygon regions. Typically, the 3D surface mesh 136 is broken up into polygon regions such as but not limited to, triangles, rectangles, and/or squares; however other polygon shapes are possible. Similarly, the 2D image file 138 is broken up into corresponding polygon regions. Furthermore, creating the UV coordinate map includes defining or assigning pixels (i.e., dots) of the 2D image (i.e., 2D image file 138) which correspond to the surface mappings included in the plurality of polygons that make up the 3D object (i.e., 3D surface mesh 136). Put another way, the UV coordinates of the UV coordinate map serve as markers that control which pixels (i.e., dots) on the 2D image correspond to specific vertices on the polygons of the 3D object.

Once the UV coordinate map of the 2D image and the 3D surface are broken up into regions, in a next block 156, the pixel (i.e., dot) information is saved or otherwise stored by the computing device 92 in the computing device memory module 104 or other such memory location. In one non-limiting example, pixel/dot information stored in the computing device memory module 104 includes the region index, course index, step index, pixel/dot color (i.e., C, M, Y, and K), nozzle index, and other such pixel/dot information. Alternatively, the pixel/dot information can be stored in the network data base 94 or other such data storage location.

Additionally, once the 3D surface mesh 136 of the contoured surface 46 and the 3D image file 138 is broken up into the respective regions or mesh faces, then in a next block 158, the simulation 124 produces and evaluates a dithering of the pixels of the 2D image file within each region or mesh face of the 3D surface mesh 136. In this case, dithering is used to expand the available colors for applying the decorative livery coating 50 along the contoured surface 46 because the ink jet print head 64 is configured with the four primary colors (C, M, Y, K) that are typically used in ink jet printing. As such, dithering uses diffusion of the available color pixels to approximate colors not included in the four colors (C, M, Y, K), or other identified color palette. As a result, dithering of the image pixels determines the specific dot colors (i.e., C, M, Y, and K) that are needed to be dispensed at specific locations along the contoured surface 46 in order to make up the pixel colors of the 2D image file 138. Furthermore, dithering of the image pixels is configured to replicate the 2D image file 138 on the 3D surface mesh 136 with the resolution in DPI that is specified in the print profile 130 or other such input parameter 128. In one non-limiting example, the print profile 130 includes a print resolution of 300 DPI for the 2D image file 138; however other resolutions for the 2D image file 138 are possible.

Furthermore, in a next block 160, the simulation 124 combines the dithering of pixels performed with block 158 with the dot information stored in the computing device memory module 104, or other such storage location in block 156. As a result, the simulation 124 then determines which dot information (i.e., region index, course index, step index, color, and nozzle index) matches up best with the dithered dots present within each region of the 3D surface mesh 136 and 2D image file 138. In one non-limiting example, the best matching dot information for each dithered dot will be selected to produce the dot that minimizes the 3D distance, produces the dot within the minimum/maximum shoot distance range defined by the dispense gap 132, and provides guaranteed surface coverage that was verified in the surface coverage test in block 150.

Referring now to block 162, the simulation 124 outputs a static print control plan for controlling the surface treatment assembly 54 during the treatment of the contoured surface 46. The simulation 124 is configured such that the static print control plan confirms that the selected best match dots include the correct course index, step index, color (C, M, Y, and K) and nozzle index. The static print control plan is prepared to be executed by the surface treatment assembly 54.

In some embodiments, the static control plan produced in block 162 is transmitted or otherwise accessed by the control system 68 for the surface treatment assembly 54. In one non-limiting example, the control plan is configured to control the automated robot assembly 56 as it moves through each step along each course along the devised movement pathway. Furthermore, at each step, the control plan is configured output the current and next position of the automated robot assembly 56 as well as the specified speed the automated robot assembly 56 is instructed to move along the movement pathway. Additionally, in some embodiments, the control plan provides scheduling instructions and trigger instructions at interpolated DPI spacing along the tool center point (TCP) axis. The scheduling and trigger instructions are confirmed to be consistent with the simulation 124 such that the decorative livery coating 50 is applied with the specified image resolution, such as but not limited to 300 DPI along the contoured surface 46. Furthermore, the control plan provides instructions executed by the controller 70 which control the surface treatment assembly 54 to apply the decorative livery coating 50 on the contoured surface 46 according to the control plan.

Figure 9:
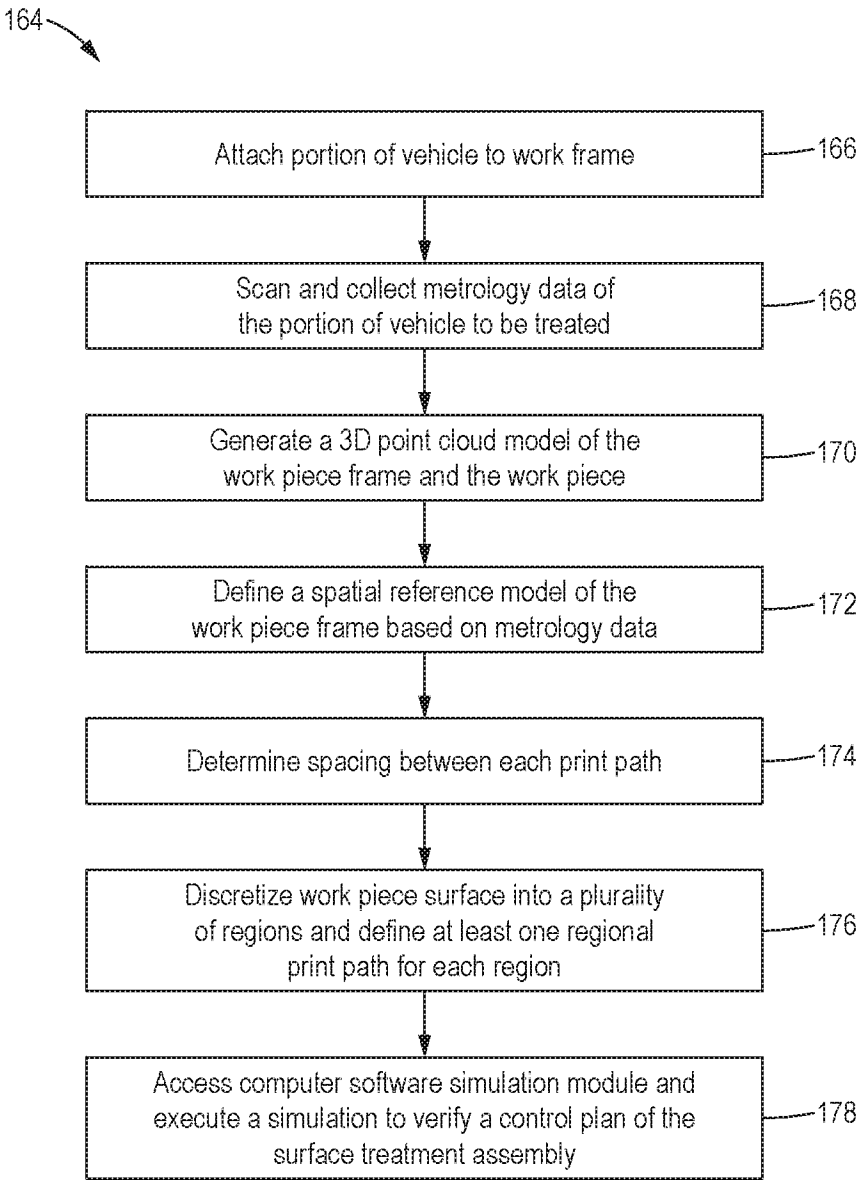
FIG. 9 is a flow chart of a method for scanning a contoured surface and collecting metrology data for use in development of a control plan of the surface treatment assembly, in accordance with the present disclosure.

A method 164 of scanning a contoured surface with a metrology system and collecting a metrology data set to be used in development and execution of a metrology-based control plan for printing a surface treatment along the contoured surface is outlined in FIG. 9, with continued reference to FIGS. 1-8. In some embodiments, the method 164 is used in conjunction with the computer software 122 and the simulation 124. The metrology system 72 scans the peripheral edge device 36, or other such component to be treated by the surface treatment assembly 54, and collects a metrology data set of the peripheral edge device 36. In some embodiments, the metrology data set collected by the metrology system 72 is used to supply several of the input parameters 128 received by the computer software 122. As such, in a first block 166 of the method 164, a portion of the vehicle 20 is removably attached to a work piece frame 52. The work piece frame 52 is then positioned within a work area 48 and prepared for a surface treatment along a contoured surface 46 of the portion of the vehicle 20. In one non-limiting example, FIG. 2 illustrates the peripheral edge device 36 as the portion of the vehicle 20 that is removably attached to the work piece frame 52. Accordingly, the peripheral edge device 36 is held and positioned by the work piece frame 52 such that the surface treatment assembly 54 can apply one or more treatments (e.g., decorative livery coating 50) along the contoured surface 46. FIG. 2 shows the peripheral edge device 36 removably secured to the work piece frame 52; however, it will be understood that other portions of the vehicle 20, such as but not limited to, the fuselage 24, the wing 26, the tail section 28 and the like can also be secured to an alternative work piece frame and prepared for treatment by the surface treatment assembly 54.

In some embodiments, the work piece frame 52 and the peripheral edge device 36 are scanned by the metrology system 72 prior to the application of the decorative livery coating 50, or other such surface treatment. As such, in a next block 168, the metrology system 72 scans the work piece frame 52 and peripheral edge device 36 prior to the development of the control plan 126 by the computer software 122, as described above. In one non-limiting example, the sensors 82, 84, 86, of the metrology system 72, scan the contoured surface 46 of the peripheral edge device and the one or more frame targets 53 attached to the work piece frame 52. As a result, a metrology data set is collected by the metrology system 72 that accurately captures or otherwise includes the as-built topography data of the contoured surface 46. Additionally, the metrology data set collected by the metrology system 72 includes metrology data related to the work piece frame 52 and the at least one frame target 53 attached to the work piece frame 52.

In a next block 170, the metrology data set collected by the metrology system 72 (e.g., contoured surface data points, work frame data points, target data points and other such data) is transmitted to the network server 90 and/or the computing device 92 and the metrology data set is used to generate a 3D point cloud model 106 by the network server 90 and/or the computing device 92. In one non-limiting example, the 3D point cloud model 106, shown in FIG. 6, creates a high resolution image (i.e., better that 3,000 pixels) of the work piece frame 52, frame targets 53, peripheral edge device 36 and surface treatment assembly 54. Moreover, the 3D point cloud model 106 includes a detailed surface topography 112 of the contoured surface 46 which shows the as-built contour of the peripheral edge device 36. In an embodiment, the 3D point cloud model 106 captures the surface topography 112 of the contoured surface 46 from the detailed peripheral edge device point cloud image 108 attached to a work piece frame point cloud image 114. As such, the data and information obtained from analysis of the 3D point cloud model 106 can be used by the computer software 122 during the simulation 124 and generation the control plan 126 the surface treatment assembly 54.

In a next block 172, the 3D point cloud model 106 is used to transform the peripheral edge device point cloud image 108 into the work piece frame point cloud image 114 as it is defined by the frame point could image 116 generated from the frame targets 53 detected by the metrology system 72. In some embodiments, the transformation of the peripheral edge device point cloud image 108 with respect to the work piece frame point cloud image 114 localizes the peripheral edge device 36 within the work piece frame 52. As a result, the surface treatment assembly 54 can accurately execute the print pathways of the surface treatment assembly 54 and print head assembly 58 to apply the decorative livery coating 50 along the contoured surface 46 of the peripheral edge device 36.

In one non-limiting example, the metrology data set collected by the metrology system 72 is used to localize the peripheral edge device 36 within the work piece frame 52 such that the automated robot assembly 56, or other such motion system, can execute the print paths of the print head assembly 58. For example, localization of the peripheral edge device 36 can be performed by defining the TCP 67 of the ink jet print head 64 using the metrology system 72. The work piece frame 52 and the frame targets 53 are scanned by the metrology system 72. Furthermore, the metrology system 72 tracks the TCP 67 of the ink jet print head 64 as the automated robot assembly 56 moves the print head assembly 58 along the contoured surface 46. As a result, a transformation capturing multiple of degrees of freedom (e.g., six degrees of freedom) between the automated robot assembly 56 axis of motion and the work piece frame 52 can be defined. This transformation can be applied to print paths generated by the control plan 126 to control the automated robot assembly 56 as it moves the print head assembly 58 along the contoured surface 46 of the peripheral edge device 36.

Alternatively, localization of the peripheral edge device 36 within the work piece frame 52 can be performed by using the metrology system 72 to scan a plurality of reference frame targets (not shown) that are located within the work area 48. The reference frame targets (not shown) are within metrology system 72 field of view and positioned within the work area 48 such that they are easily detected by the metrology system 72 during treatment of the peripheral edge device 36, or other such component having a contoured surface 46. The three reference frame targets (not shown) are scanned and their location is noted at the same time that when the TCP 67 of the ink jet print head 64 is being defined. As a result, a fixed reference frame is simultaneously defined between the TCP 67 of the ink jet print head 64 and the reference frame targets (not shown) that is visible or otherwise detectable to the metrology system 72. Thus, print path planning can be performed using the part frame scan discussed above and when the work piece frame 52 is positioned within the work area 48, the work piece frame 52 and peripheral edge device 36 can be localized within the work area 48 based on the known positions of the reference frame targets (not shown).

In a next block 174, the data collected by the metrology system 72 is used to define or otherwise determine the spacing between each print path and swath made by the surface treatment assembly 54. In an embodiment, the print path or swath spacing is determined based on the ink jet print head 64 orientation and the principal print direction of the print head assembly 58. For example, each print path or swath includes a variety of coordinates that are defined within the work piece frame 52. More specifically, each print path or swath includes a sequence of XYZABCU coordinate values defined within a three-dimensional space such as 3D axis 65 shown in FIG. 2. The XYZ coordinates define the position in space, or the multi-dimensional center position (i.e., 3D position) of the ink jet print head 64 center point (i.e., TCP 67) and the ABC coordinates are Euler angles which specify the ink jet print head 64 orientation about the TCP 67. Furthermore, the U value is a linear axis the TCP 67 of the ink jet print head 64 travels along during application of the decorative livery coating 50. The linear axis of the TCP 67 can be used along with hardware encoder signals transmitted between components of the surface treatment assembly 54 to correlate positioning of external hardware of the surface treatment assembly 54 with the print head assembly 58.

Moreover, in a next block 176 the 3D point cloud model 106 is used in print path or swath planning by discretizing the contoured surface 46 into a plurality of independent planar regions. The print paths or swaths of the independent planar regions are defined independently from one another. As a result, during the planning of the print paths or swaths, the surface of each region is oriented and/or reoriented such that the X coordinate of 3D axis 65 is defined as the nominal print direction along the contoured surface 46 and the Z coordinate of the 3D axis 65 is defined having a normal orientation with respect to the ink jet print head 64. Additionally, discretizing the contoured surface 46 into a plurality of independent regions includes fitting a polynomial into the surface of each region according to the function $z=f(x, y)$.

Furthermore, each print path or swath within a region is defined with a uniform spacing according to the y coordinate such that complete coverage is provided according to the x coordinate. In some embodiments, the z coordinate is sampled from each print path or swath of the polynomial fit at each defined print path or swath x-y coordinate. The discretizing further includes sampling a surface neighborhood at each print path or swath point (x, y, z). Additionally, a plane is fit to the surface to define a normal orientation and to apply a shift or offset based on a standoff or dispense gap distance between the ink jet print head 64 and the contoured surface 46. In one non-limiting example, the shift of the print head assembly 58 is determined by a normalization of the print head assembly 58 to the plane which is fit into the surface, or particular region, of the plurality of regions. Furthermore, the standoff or dispense gap distance is defined to be 5 millimeters or less; however other standoff or dispense gap are possible. Moreover, at each print path or swath point (x, y, z), the ink jet print head 64 orientation is defined having a normal orientation between the ink jet print head 64 and the plane fit into the surface. The ink jet print head 64 further includes a direction vector pointed towards the next print path or swath point (x, y, z). In some embodiments, a subsample of each print path or swath can be taken based on predefined smoothness tolerances between each region. In one non-limiting example, the smoothness tolerance is defined as point-to-point print head orientation differences are 0.1 degree or less; however other predefined orientation differences are possible.

In some embodiments, the metrology data set and other information collected by the metrology system 72 is referenced by the computer software 122. As discussed above, the computer software 122 includes the simulation 124 which is programmed to execute a computerized simulation of the movement of the surface treatment assembly 54. As such, in a next block 178, the computer software 122 may utilize metrology data of the peripheral edge device 36 contoured surface 46 collected by the metrology system 72. Moreover, a variety of input parameters 128 of the computer software 122 can be obtained from the 3D point cloud model 106. Furthermore, some embodiments of the simulation 124 performed by the computer software 122 refers to the plurality of regions defined along the contoured surface 46 based on the metrology data set. Additionally, the executed simulation 124 confirms that the at least one regional print path defined for each region of the plurality of regions executes properly to apply or otherwise dispense the decorative livery coating 50 along the contoured surface 46.

The confirmation provided by the simulation 124 ensures that the print head assembly 58 completely and accurately covers the contoured surface 46 with the decorative livery coating 50. Additionally, the simulation 124 confirms that the defined dispense gap 132 or standoff distance between the ink jet print head 64 and the contoured surface 46 is correct. To endure proper printing along the contoured surface 46, some embodiments require the dispense gap or standoff distance of the ink jet print head 64 to be 5 mm or less. As such, an incorrect dispense gap or standoff distance between the ink jet print head 64 and contoured surface affects print quality. Furthermore, if the dispense gap is set to small the print head assembly 58 and other components of the surface treatment assembly 54 could contact the contoured surface 46. Such contact could damage the contoured surface, the surface treatment assembly 54 and/or both.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A method of collecting a metrology data set of a contoured surface with a metrology system and executing an automated metrology-based control plan for printing on the contoured surface, the method comprising:

attaching a work piece, having the contoured surface to be printed on, to a work piece frame, the work piece frame including at least one frame target;

scanning the contoured surface of the work piece and the work piece frame, with the metrology system, to obtain the metrology data set of the work piece having the contoured surface;

generating a three-dimensional point cloud model, with a computing device, of the work piece frame and the work piece having the contoured surface, the three-dimensional point cloud model based on the metrology data set;

defining a spatial reference model of the work piece frame based on a detection of the at least one frame target by the metrology system;

defining a print path for a print head assembly of a surface treatment assembly to follow as the surface treatment assembly prints along the contoured surface, the print path based off the three-dimensional point cloud model;

discretizing the contoured surface of the work piece into a plurality of regions, wherein the print path is further defined into at least one independent regional print path for each region of the plurality of regions; and accessing a computer software, with the computing device, including a simulation module, wherein the computer software receives the plurality of regions of the contoured surface and the at least one independent regional print path for each region of the plurality of regions, and wherein the simulation module executes a simulation of the movement of the surface treatment assembly to verify a control plan programmed to control the surface treatment assembly during printing along the contoured surface.

2. The method of claim 1, wherein defining the at least one independent regional print path of the plurality of regional print paths includes determining a swath spacing based on a set of dimensions of the print head assembly and a principal print direction of the print head assembly, and wherein the three-dimensional point cloud model is reoriented such that the principal print direction is defined along an X axis of the print path and the print head assembly is normalized to a Z axis of the print path.

3. The method of claim 2, wherein a polynomial of the three-dimensional point cloud model is fit into each region of the plurality of regions, and wherein defining the at least one independent regional print path of the plurality of regional print paths includes determining a uniform spacing along a Y axis of the print path to provide complete coverage of the polynomial along the X axis of the print path.

4. The method of claim 3, wherein the set of dimensions of the print head assembly includes a print head standoff distance defined along the Z axis between the print head assembly and the contoured surface, and wherein the print head standoff distance is sampled at a plurality of X-Y coordinate positions along the at least one independent regional print path of the plurality of regional print paths defined for each region of the plurality of regions.

5. The method of claim 4, further including determining a shift of the print head assembly at each X-Y coordinate position of the plurality of X-Y coordinate positions based on fitting a plane into a particular region of the plurality of regions, wherein determining the shift of the print head assembly includes normalizing the print head assembly to the plane fit into the particular region of the plurality of regions, and wherein a vector of the principal print direction is directed to an adjacent X-Y coordinate position of the plurality of X-Y coordinate positions.

6. The method of claim 5, wherein the shift of the print head assembly is limited to a predetermined magnitude established between a first predetermined X-Y coordinate position and a second predetermined X-Y coordinate position of the plurality of X-Y coordinate positions, and wherein the print path is re-oriented within the particular region of the plurality of regions according to the first predetermined X-Y coordinate position and the second predetermined coordinate position.

7. The method of claim 1, wherein defining the print path further includes defining a set of print head assembly values that further define a multi-dimensional center position of the print head assembly, a set of angles specifying an orientation of the print head assembly about the multi-dimensional center position, and a linear print head center point axis, and wherein the linear print head center point axis establishes a correlation between the contoured surface and the print head assembly using one or more print head encoder signals.

8. A metrology system for collecting a metrology data set along a contoured surface, the metrology data set used in development of a control plan for a surface treatment assembly configured to print along the contoured surface, the metrology system comprising:

at least one sensor configured to scan a work piece frame, the work piece frame including at least one frame target, the work piece frame removably attached to a work piece having the contoured surface, the metrology data set including metrology data of the work piece frame, the at least one frame target, and the work piece having the contoured surface; and a computing device communicably coupled to the metrology system and programmed to:

receive the metrology data set, analyze the metrology data set, generate a three-dimensional point cloud model of the work piece frame and the work piece having the contoured surface based on the analyzed metrology data set, define a spatial reference model of the work piece frame based on the three-dimensional point cloud model and detection of the at least one frame target coupled to the work piece frame by the metrology system, define a print path for a print head assembly of the surface treatment assembly to follow as the surface treatment assembly prints along the contoured surface, the print path based off the three-dimensional point cloud model, discretize the contoured surface into a plurality of regions, wherein the print path is further defined into at least one independent regional print path for each region of the plurality of regions, and access a computer software including a simulation module, wherein the computer software receives the plurality of regions of the contoured surface and the at least one independent regional print path for each region of the plurality of regions, and wherein the simulation module executes a simulation of the movement of the surface treatment assembly to verify a control plan programmed to control the surface treatment assembly during printing along the contoured surface.

9. The metrology system of claim 8, wherein the at least one independent regional print path of the plurality of regional print paths defined by the computing device includes a swath spacing based on a set of dimensions of the print head assembly and a principal print direction of the print head assembly, and wherein the three-dimensional point cloud model is reoriented such that the principal print direction is defined along an X axis of the print path and the print head assembly is normalized to a Z axis of the print path.

10. The metrology system of claim 9, wherein a polynomial of the three-dimensional point cloud model is fit into each region of the plurality of regions, and wherein defining the at least one independent regional print path of the plurality of regional print paths includes determining a uniform spacing along a Y axis of the print path to provide complete coverage of the polynomial along the X axis of the print path.

11. The metrology system of claim 10, wherein the set of dimensions of the print head assembly includes a print head standoff distance defined along the Z axis between the print head assembly and the contoured surface, and wherein the print head standoff distance is sampled at a plurality of X-Y coordinate positions corresponding to the X along the at least one independent regional print path of the plurality of regional print paths defined for each region of the plurality of regions.

12. The metrology system of claim 11, wherein a shift of the print head assembly is determined at each X-Y coordinate position of the plurality of X-Y coordinate positions based on fitting a plane into a particular region of the plurality of regions, wherein the shift of the print head assembly is determined by a normalization of the print head assembly to the plane fit into the particular region of the plurality of regions, and wherein a vector of the principal print direction is directed to an adjacent X-Y coordinate position of the plurality of X-Y coordinate positions.

13. The metrology system of claim 12, wherein the shift of the print head assembly is limited to a predetermined magnitude established between a first predetermined X-Y coordinate position and a second predetermined X-Y coordinate position of the plurality of X-Y coordinate positions, and wherein the print path is re-oriented within the particular region of the plurality of regions according to the first predetermined X-Y coordinate position and the second predetermined coordinate position.

14. The metrology system of claim 8, wherein definition of the print path further includes defining a set of print head assembly values that further define a multi-dimensional center position of the print head assembly, a set of angles specifying an orientation of the print head assembly about the multi-dimensional center position, and a linear print head center point axis, and wherein the linear print head center point axis establishes a correlation between the contoured surface and the print head assembly using one or more print head encoder signals.

15. An automated surface treatment assembly communicably coupled to a metrology system for collecting a metrology data set along a contoured surface, the automated surface treatment assembly configured to utilize the metrology data set during printing of a surface treatment along the contoured surface, the automated surface treatment assembly comprising:

a print head assembly configured for printing a surface treatment along the contoured surface;

an automated robot assembly operably coupled to the print head assembly and configured to position and move the print head assembly along the contoured surface;

at least one sensor operably coupled to the metrology system and configured to scan a work piece frame including at least one frame target, and a work piece having the contoured surface, the work piece removably attached to the work piece frame, wherein the metrology data set includes metrology data of the work piece frame, the at least one frame target, and the work piece having the contoured surface;

a control system communicably coupled to the automated surface treatment assembly and the metrology system, the control system configured to control and execute a plurality of operational control signals for each of the automated surface assembly and the metrology system; and a computing device communicably coupled to the control system, the automated surface treatment assembly, and the metrology system, the computing device programmed to:

receive the metrology data set, analyze the metrology data set, generate a three-dimensional point cloud model of the work piece frame and the work piece having the contoured surface based on the analyzed metrology data set, define a spatial reference model of the work piece frame based on the three-dimensional point cloud model and detection of the at least one frame target coupled to the work piece frame by the metrology system, define a print path for a print head assembly of the automated surface treatment assembly to follow as the automated surface treatment assembly prints along the contoured surface, the print path based off the three-dimensional point cloud model, discretize the contoured surface into a plurality of regions, wherein the print path is further defined into at least one independent regional print path for each region of the plurality of regions, and access a computer software including a simulation module, wherein the computer software receives the plurality of regions of the contoured surface and the at least one independent regional print path for each region of the plurality of regions, and wherein the simulation module executes a simulation of the movement of the surface treatment assembly to verify a control plan programmed to control the automated surface treatment assembly during printing along the contoured surface.

16. The automated surface treatment assembly of claim 15, wherein the at least one independent regional print path of the plurality of regional print paths defined by the computing device includes a swath spacing based on a set of dimensions of the print head assembly and a principal print direction of the print head assembly, and wherein the three-dimensional point cloud model is reoriented such that the principal print direction is defined along an X axis of the print path and the print head assembly is normalized to a Z axis of the print path.

17. The automated surface treatment assembly of claim 16, wherein a polynomial of the three-dimensional point cloud model is fit into each region of the plurality of regions, and wherein defining the at least one independent regional print path of the plurality of regional print paths includes determining a uniform spacing along a Y axis of the print path to provide complete coverage of the polynomial along the X axis of the print path.

18. The automated surface treatment assembly of claim 17, wherein the set of dimensions of the print head assembly includes a print head standoff distance defined along the Z axis between the print head assembly and the contoured surface, and wherein the print head standoff distance is sampled at a plurality of X-Y coordinate positions corresponding to the X along the at least one independent regional print path of the plurality of regional print paths defined for each region of the plurality of regions.

19. The automated surface treatment assembly of claim 15, wherein a shift of the print head assembly is determined at each X-Y coordinate position of the plurality of X-Y coordinate positions based on fitting a plane into a particular region of the plurality of regions, wherein the shift of the print head assembly is determined by a normalization of the print head assembly to the plane fit into the particular region of the plurality of regions, and wherein a vector of a principal print direction is directed to an adjacent X-Y coordinate position of the plurality of X-Y coordinate positions.

20. The automated surface treatment assembly of claim 19, wherein the shift of the print head assembly is limited to a predetermined magnitude established between a first predetermined X-Y coordinate position and a second predetermined X-Y coordinate position of the plurality of X-Y coordinate positions, and wherein the print path is reoriented within the particular region of the plurality of regions according to the first predetermined X-Y coordinate position and the second predetermined coordinate position.

* * * * *